US009549438B2

(12) United States Patent
Hofmann et al.

(10) Patent No.: US 9,549,438 B2
(45) Date of Patent: Jan. 17, 2017

(54) MICROWAVE OVEN WITH AT LEAST ONE WAVE CHOKE SYSTEM

(75) Inventors: Arnd Hofmann, Lülsfeld (DE); Abdel-Ilah Zbat, Wurzburg (DE)

(73) Assignee: ELECTROLUX HOME PRODUCTS CORPORATION N.V., Brussels (BE)

( * ) Notice: Subject to any disclaimer, the term of this patent is extended or adjusted under 35 U.S.C. 154(b) by 403 days.

(21) Appl. No.: 13/265,152

(22) PCT Filed: May 10, 2010

(86) PCT No.: PCT/EP2010/002851
§ 371 (c)(1),
(2), (4) Date: Dec. 12, 2011

(87) PCT Pub. No.: WO2010/136119
PCT Pub. Date: Dec. 2, 2010

(65) Prior Publication Data

US 2012/0091128 A1 Apr. 19, 2012

(30) Foreign Application Priority Data

May 29, 2009 (EP) ..... 09007177

(51) Int. Cl.
*H05B 6/76* (2006.01)

(52) U.S. Cl.
CPC ..... *H05B 6/763* (2013.01)

(58) Field of Classification Search
CPC ..... H05B 6/76; H05B 6/763; H05B 6/766; H05B 6/6414; H05B 6/64; H05B 6/642; H03H 1/0007; H04B 3/28; H01F 17/06
(Continued)

(56) References Cited

U.S. PATENT DOCUMENTS 3,668,357 A 6/1972 Kabayashi
3,835,283 A 9/1974 Suzuki
(Continued)

FOREIGN PATENT DOCUMENTS

GB 2106360 4/1983
GB 2122059 1/1984

OTHER PUBLICATIONS

International Search Report for PCT/EP2010/02851, dated Aug. 24, 2010, 2 pages.

*Primary Examiner* — Dana Ross
*Assistant Examiner* — Kuangyue Chen
(74) *Attorney, Agent, or Firm* — Pearne & Gordon LLP

(57) ABSTRACT

The present invention relates to a microwave oven with at least one wave choke system. A front frame (12) encloses a front portion of a cavity wall (24) of an oven cavity (10) along a circumferential direction. An oven door (14) is provided to cover front sides of the oven cavity (10) and front sides of the cavity wall (24) completely and the front frame (12) at least partially in a closed state of said oven door (14). A first gap (16) is formed between the inner side of the oven door (14) on the one hand and front sides both of the front frame (12) and the cavity wall (24) on the other hand. A second gap (18) is formed between the front portions of the front frame (12) and the cavity wall (24). The cross-section of the second gap (18) extends perpendicularly to the cross-section of the first gap (16). A wave choke system is arranged within the second gap (18). The wave choke system comprises a plurality of choke members (26) and a counter part (28). There is no direct electric contact between the choke members (26) on the one hand and the counter part (28) on the other hand. Further, the present invention relates to a corresponding wave choke system for a microwave oven.

21 Claims, 4 Drawing Sheets

Figure 1:
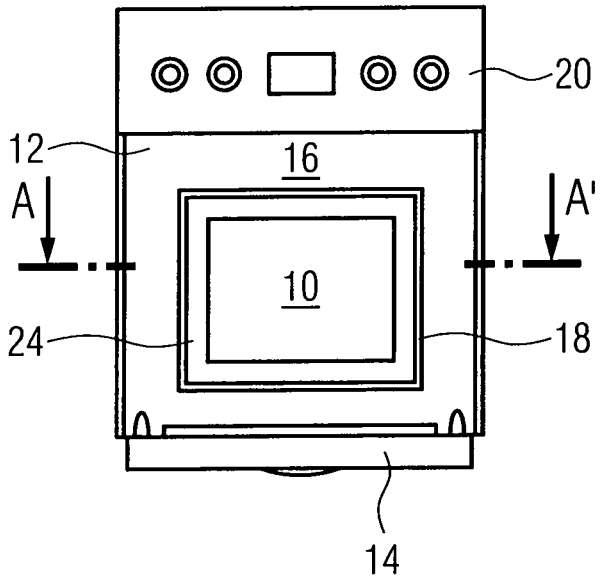

(58) Field of Classification Search
USPC ..... 219/736, 738–744, 745, 699, 729, 757
See application file for complete search history.

(56) References Cited

U.S. PATENT DOCUMENTS

| | | | | | |
|---|---|---|---|---|---|
| 4,081,647 | A | | 3/1978 | Torrey | |
| 4,475,023 | A | * | 10/1984 | Iwabuchi et al. | 219/742 |
| 4,498,453 | A | * | 2/1985 | Ueda | F24C 15/322 126/21 A |
| 4,814,571 | A | * | 3/1989 | Bowen et al. | 219/757 |
| 5,418,352 | A | * | 5/1995 | Cho | 219/742 |
| 5,705,797 | A | * | 1/1998 | Seo | 219/742 |
| 5,973,305 | A | * | 10/1999 | Kim et al. | 219/742 |
| 7,301,132 | B2 | * | 11/2007 | Kim et al. | 219/742 |
| 2003/0141298 | A1 | * | 7/2003 | Lee et al. | 219/741 |
| 2005/0056639 | A1 | * | 3/2005 | Hu et al. | 219/739 |

* cited by examiner

MICROWAVE OVEN WITH AT LEAST ONE WAVE CHOKE SYSTEM

The present invention relates to a microwave oven with at least one wave choke system. Further, the present invention relates to a corresponding wave choke system for a microwave oven.

Microwave ovens generate electromagnetic fields in order to heat food stuff and beverages. In order to assure an easy-going usage, a thorough sealing with respect to microwave leakage is mandatory. The strong electromagnetic fields generated by microwave ovens are a potential threat to the health of the operator, if said electromagnetic fields or parts of them leave the cavity. The door of the microwave oven is a critical part. In particular, microwaves may leave the cavity through the gap between the door and the front frame around the oven cavity. Even low remaining field amplitudes staying inside the casing can cause problems on any electronic components of the microwave oven.

Another aspect is the energy consumption of the microwave oven. The increasing energy costs require microwave ovens with low energy consumption. In particular, microwave ovens with additional conventional heating functions should have minimal thermal losses. For this purpose a circumferential air gap between the front portion of the cavity wall and the front frame is an efficient isolator.

It is an object of the present invention to provide a microwave oven with an improved microwave sealing and thermal isolation device, wherein the complexity of said microwave sealing and said thermal isolation device is relative low.

The microwave oven according to the present invention includes at least one wave choke system, wherein

- a front frame encloses a front portion of a cavity wall of an oven cavity along a circumferential direction,
- an oven door is provided to cover front sides of the oven cavity and front sides of the cavity wall completely and the front frame at least partially in a closed state of said oven door,
- a first gap is formed between the inner side of the oven door on the one hand and front sides both of the front frame and the cavity wall on the other hand,
- a second gap is formed between the front portions of the front frame and the cavity wall,
- the cross-section of the second gap extends perpendicularly to the cross-section of the first gap,
- a wave choke system is arranged within the second gap,
- the wave choke system comprises a plurality of choke members and a counter part, and
- there is no direct electric contact between the choke members on the one hand and the counter part on the other hand.

The core idea of the present invention is the arrangement of the wave choke system within the second gap, which acts as a thermal insulation gap. Typically, the wave choke system forms an LC or RLC resonant circuit. The dimensions of the wave choke system are independent of the state of the oven door. The thermal expansions of the oven cavity have only less influence on the dimensions of the wave choke system. The second gap can be used for a fine tuning of the frequency behaviour of the wave choke system.

According to the preferred embodiment of the present invention the choke members are fixed at or are a part of the front frame and the counter part is fixed at or is a part of the cavity wall.

Alternatively the choke members are fixed at or are a part of the cavity wall and the counter part is fixed at or is a part of the front frame.

For example, the choke members are formed as lamellae, in particular as lamellae of an LC/RLC resonant circuit. Preferably, at least one part of the choke members is arranged in a row.

According to the preferred embodiment of the present invention at least a part of the choke members is formed as a profile rail with a plurality of recesses forming the interspace between the choke members. Preferably, the recesses are formed as slots with one open end and extend perpendicular to the length axis of the profile rail.

Further, the cross-section of the choke member may comprise a number of sections substantially formed as plane sheets. For example, the choke member comprises two to seven sections.

The adjacent sections of the choke member may form an angle from −90° to 180°. Sharp edges between adjacent sections of the choke member can be replaced by rounded bends. At least a number of the adjacent sections may be orthogonal to each other.

According to the preferred embodiment of the present invention the microwave oven comprises at least one gasket covering the front side of the second gap. The gasket reduces the thermal losses.

In particular, the microwave oven may comprise a flat oven door. Further, the microwave oven may comprise an additional wave choke system arranged within the outer portion of the flat oven door and enclosing the opening of the oven cavity.

The present invention relates also to a wave choke system for a microwave oven as described above.

Figure 2:
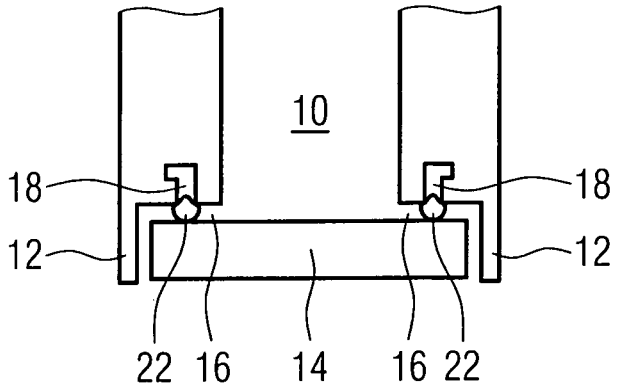
Figure 3:
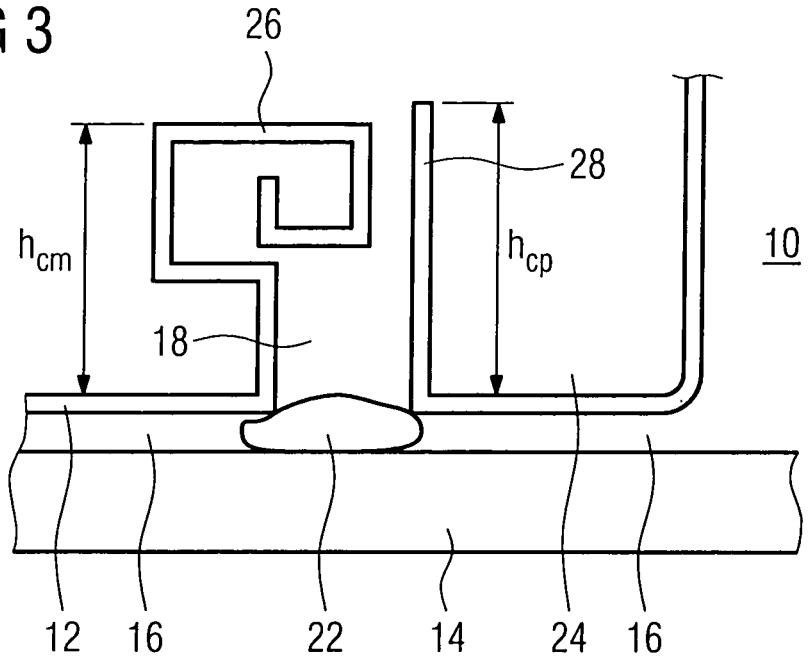
Figure 4:
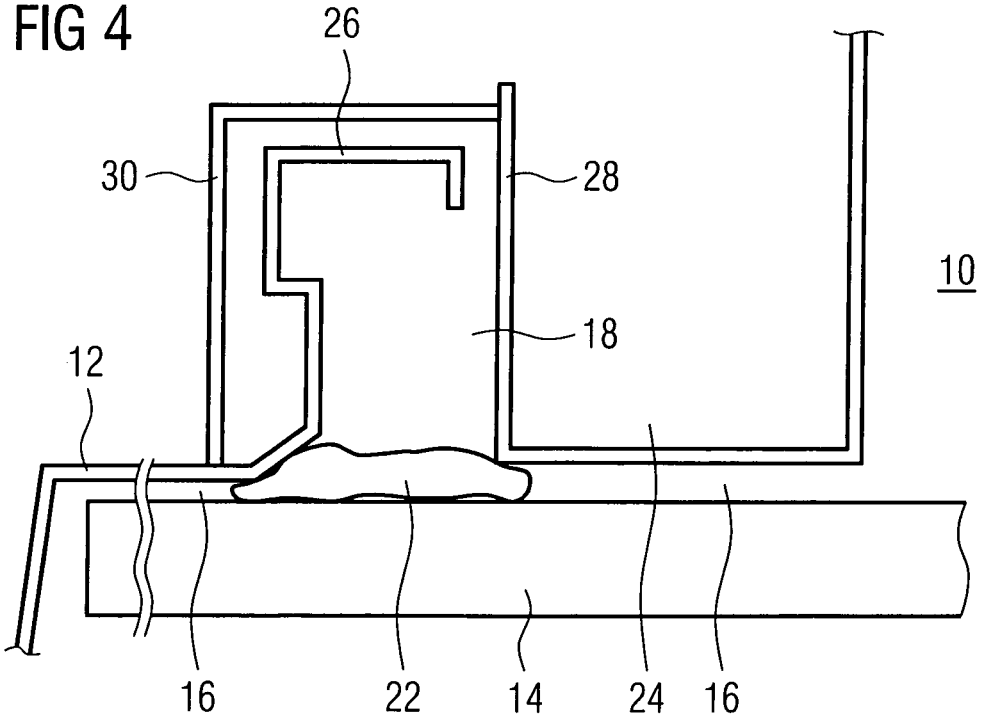
Figure 5:
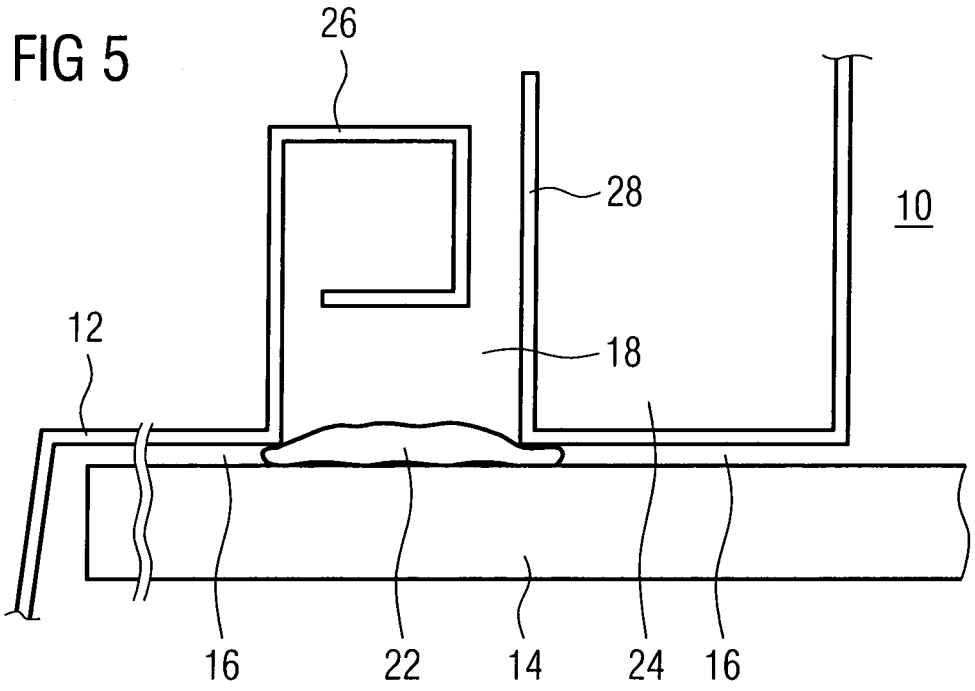
Figure 6:
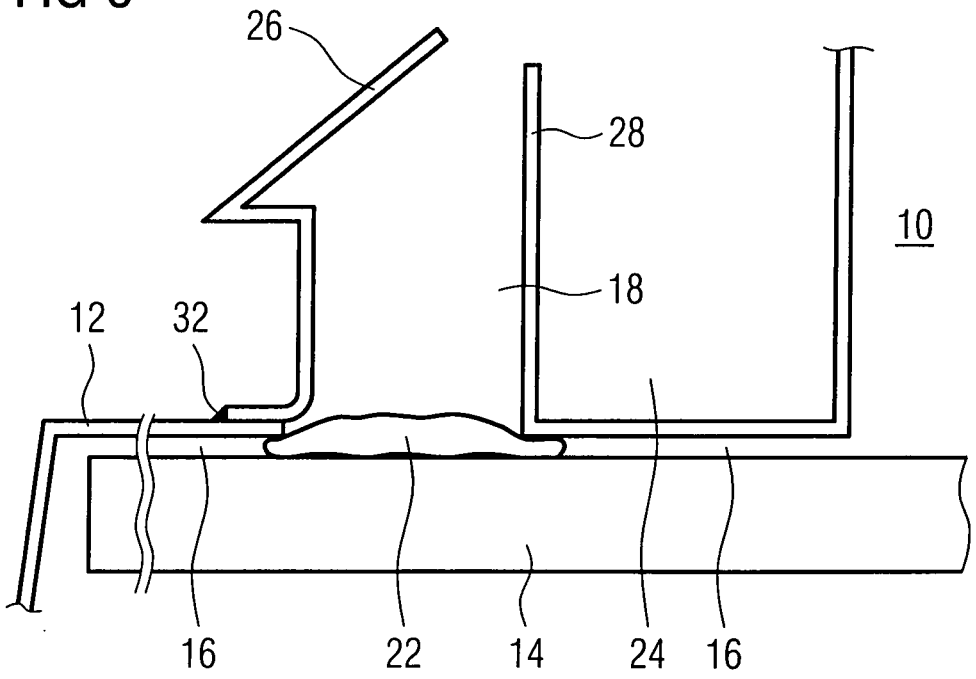
Figure 7:
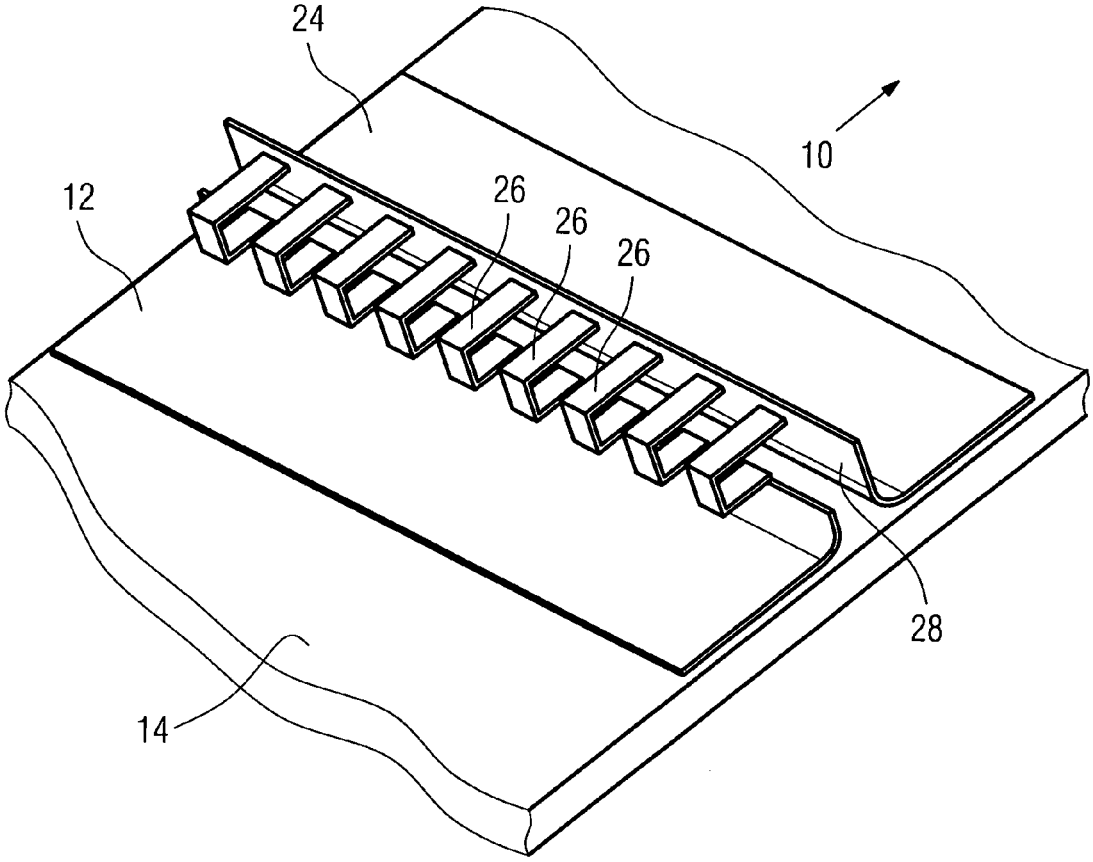

The invention will be explained in more detail below by means of exemplary embodiments. Reference is thereby made to the drawings, wherein FIG. 1 shows a schematic front view of a microwave oven with an opened oven door according to a preferred embodiment of the present invention, FIG. 2 shows a schematic sectional top view of a front portion of the microwave oven with an opened oven door along the line A-A' in FIG. 1, FIG. 3 shows a detailed sectional top view of a wave choke system according to a first example of the present invention, FIG. 4 shows a detailed sectional top view of the wave choke system according to a second example of the present invention, FIG. 5 shows a detailed sectional top view of the wave choke system according to a third example of the present invention, FIG. 6 shows a detailed sectional top view of the wave choke system according to a fourth example of the present invention, and FIG. 7 shows a perspective view of a further example of the wave choke system according to the present invention.

FIG. 1 shows a schematic front view of a microwave oven with an opened oven door 14 according to a preferred embodiment of the present invention. The microwave oven comprises an oven cavity 10 and a front frame 12. The oven cavity 10 is enclosed by a cavity wall 24. The front frame 12 encloses circumferentially the front portion of the cavity wall 24. A control panel 20 is arranged above the oven cavity 10 and the front frame 12.

In the closed state of the oven door 14 there is a first gap 16 between an inner side of the oven door 14 on the one hand and the front sides of the front frame 12 and cavity walls 24 on the other hand. A second gap 18 is arranged between the front frame 12 and the cavity wall 24. The second gap 18 encloses circumferentially the front portions of the cavity wall 24 and of the oven cavity 10. The cross-section of the second gap 18 extends perpendicular to the cross-section of the first gap 16.

The width of the second gap 18 is independent of the state of the oven door 14. A wave choke system is arranged within the second gap 18. Since the wave choke system is arranged between unmovable parts of the microwave oven, the dimensions of the second gap 18 and the wave choke system are constant.

FIG. 2 shows a schematic sectional top view of a front portion of the microwave oven with a closed oven door 14 along the line A-A' in FIG. 1. The first gap 16 is arranged between the inner side of the oven door 14 on the one hand and the front sides of the cavity wall 24 and the front frame 12 on the other hand. The first gap 16 extends parallel to the plane of the oven door 14. The oven door 14 is formed as a so-called flat door.

The second gap 18 is arranged between the front frame 12 and the cavity wall 24. The cross-section of the second gap 18 extends perpendicular to the cross-section of the first gap 16.

A gasket 22 is clamped within the first gap 16 and closes the second gap 18. The gasket 22 is arranged between the inner side of the oven door 14 and the second gap 18. The gasket 22 reduces the thermal losses of the microwave oven.

FIG. 3 shows a detailed sectional top view of a wave choke system according to a first example of the present invention. The wave choke system is arranged within the second gap 18. The wave choke system comprises a plurality of choke members 26 and a counter part 28.

In this example the choke members 26 are integral parts of the front frame 12. The counter part 28 of the wave choke system forms a continuation of the cavity wall 24. The height $h_{cm}$ of the choke members 26 is smaller than the height $h_{cp}$ of the counter part 28.

The choke members 26 are arranged in a row and are formed as lamellae. In other words, the choke members 26 are a profile rail with a plurality of U-shaped recesses extending perpendicular to length axis of the profile rail.

The cross-section of each choke member 26 includes seven sections. Two adjacent sections of the choke member 26 are orthogonal to each other. The wave choke system forms an LC or an RLC resonance circuit.

The gasket 22 is clamped between the front frame 12, the cavity wall 24 and the oven door 14. The gasket 22 closes the front side of the second gap 18.

In an alternative example the choke members 26 may be integral parts of the cavity wall 24 and the counter part 28 may by an integral part of the front frame 12.

FIG. 4 shows a detailed sectional top view of the wave choke system according to a second example of the present invention. The wave choke system is also arranged within the second gap 18. The wave choke system comprises also a plurality of choke members 26 and a counter part 28. The choke members 26 are integral parts of the front frame 12, and the counter part 28 forms a continuation of the cavity wall 24.

The difference between the first and second example is the form of choke members 26. In this example, the cross-section of each choke member 26 has six sections. The first section forms an angle of about 45° with the front frame 12. Between the first and second section there is also an angle of about 45°. The adjacent sections of the second to the sixth sections are orthogonal to each other. The wave choke system forms an LC or an RLC resonance circuit.

The gasket 22 is clamped between the front frame 12, the first section of the choke member 26, the cavity wall 24 and the oven door 14. The gasket 22 closes the front side of the second gap 18.

Additionally the microwave oven of the second example includes a cover 30 arranged between the front frame 12 and the counter part 28. The cover 30 is formed as an L-shaped profile and covers the choke members 26. The cover 30 is made of a dielectric material. The cover 30 prevents, that insulating material from the casing of the microwave oven gets into the interior of the wave choke system, in particular between the choke members 26 and the counter part 28 of the wave choke system.

FIG. 5 shows a detailed sectional top view of the wave choke system according to a third example of the present invention. The wave choke system is also arranged within the second gap 18.

The third example differs from the first example in the form of the choke members 26. In the third example, the cross-section of the choke members 26 has four sections. The first section of the choke members 26 is orthogonal to the front frame 12. The other adjacent sections are also orthogonal to each other.

The gasket 22 is clamped between the front frame 12, the cavity wall 24 and the oven door 14. The gasket 22 closes the front side of the second gap 18.

FIG. 6 shows a detailed sectional top view of the wave choke system according to a fourth example of the present invention. The wave choke system is also arranged within the second gap 18.

The fourth example differs from the other examples in the form of the choke members 26. In this example, the cross-section of the choke members 26 has also four sections. The adjacent sections of the first to the third sections are orthogonal to each other. The third and fourth sections form an angle of about 45°.

While the choke members 26 and the front frame 12 of the other examples form a single-piece part, the choke members 26 of the fourth example are fixed at the front frame 12 by a welded seam 32.

The gasket 22 is also clamped between the front frame 12, the cavity wall 24 and the oven door 14. The gasket 22 closes the front side of the second gap 18.

FIG. 7 shows a perspective view of a further example of the wave choke system according to the present invention. FIG. 7 illustrates a section of the front frame 12, of the cavity wall 24 and of the oven door 14.

The choke members 26 comprise five sections, wherein the adjacent sections of the second to the fifth sections are orthogonal to each other. The first section has a bended cross-section. In this example the recesses between the choke members 26 extend only from the third to the fifth section. The counter part 28 is a continuation of the cavity wall 24.

In all described examples an alternative constellation is possible. In said alternative constellation, the choke members 26 are fixed at or are a part of the cavity wall 24, and the counter part 28 is fixed at or is a part of the front frame 12.

The inventive wave choke system is provided to enclose completely or at least partially the opening of the oven cavity 10.

The shape of the choke members 26 can vary along the circumference of the gap.

Sharp edges between two adjacent choke members 26 can be replaced by rounded bends.

The gasket 22 covering the front side of the second gap 18 can be a conventional gasket or a gasket for special applications in order to keep the heat, odour or moisture inside the oven cavity 10. For example, the gasket 22 may be provided for steam or pyrolytic cleaning.

The cover 30 shown in FIG. 4, which is made of a dielectric material, or a similar cover can also be provided for the other examples describes above. Said cover 30 prevents, that the insulating material of the microwave oven gets into the interior of the wave choke system, in particular between the choke members 26 and the counter part 28 of the wave choke system.

Preferably, the wave choke system according to present invention is only one of several wave choke systems of the microwave oven. In particular, another wave choke system may be arranged within the outer portion of the oven door 14, wherein the other wave choke system encloses completely or partially the opening of the oven cavity 10.

LIST OF REFERENCE NUMERALS

10 oven cavity
12 front frame
14 oven door
16 first gap
18 second gap
20 control panel
22 gasket
24 cavity wall
26 choke member
28 counter part
30 cover
32 welded seam
$h_{cm}$ height of the choke member
$h_{cp}$ height of the counter part

The invention claimed is:

1. A microwave oven with an additional conventional heating function comprising:

an oven cavity (10) formed as a casing with two side cavity walls, a top cavity wall, a bottom cavity wall, a rear cavity wall, and an open front side;

a front frame (12) attached at front portions of the two side cavity walls, the top cavity wall, and the bottom cavity wall, said front frame (12) enclosing the front portions of the two side cavity walls, the top cavity wall, and the bottom cavity wall along a circumferential direction;

an oven door (14) for covering the open front side of the oven cavity (10) completely and the front frame (12) at least partially in a closed state of said oven door (14);

microwave heating components for generating electromagnetic fields;

a conventional heating function;

a first gap (16) formed between an inner side of the oven door (14), and both the front frame (12) and the front portions of the two side cavity walls, the top cavity wall, and the bottom cavity wall, wherein at least one size dimension of the first gap (16) varies when the oven door (14) is opened;

a second gap (18) for thermal insulation between the oven cavity (10) and the front frame (12), said second gap (18) being formed between the front frame (12) and the front portions of the two side cavity walls, the top cavity wall, and the bottom cavity wall, wherein:

the second gap (18) dimensions are constant when the oven door (14) is opened, the second gap (18) encloses the front portions of the two side cavity walls, the top cavity wall, and the bottom cavity wall along a circumferential direction, and the second gap (18) extends perpendicularly to the first gap (16).

2. The microwave oven according to claim 1, characterized in that the microwave oven comprises at least one gasket (22) covering a front side of the second gap (18).

3. The microwave oven according to claim 1, characterized in that the microwave oven comprises a flat oven door.

4. The microwave oven according to claim 1, further comprising a wave choke system arranged within the second gap (18), said wave choke system comprising a plurality of choke members (26) and a counter part (28), wherein there is no direct electric contact between the choke members (26) and the counter part (28).

5. The microwave oven according to claim 4, wherein the choke members (26) are fixed at or are a part of the front frame (12) and the counter part (28) is fixed at or is a part of the front portions of the two side cavity walls, the top cavity wall, and the bottom cavity wall.

6. The microwave oven according to claim 4, wherein the choke members (26) are fixed at or are a part of the front portions of the two side cavity walls, the top cavity wall, and the bottom cavity wall and the counter part (28) is fixed at or is a part of the front frame (12).

7. The microwave oven according to claim 4, wherein the choke members (26) are formed as lamellae, in particular as lamellae of an LC/RLC resonant circuit.

8. The microwave oven according to claim 4, wherein at least one part of the choke members (26) is arranged in a row.

9. The microwave oven according to claim 4, wherein at least a part of the choke members (26) is formed as a profile rail with a plurality of recesses forming the interspace between the choke members (26).

10. The microwave oven according to claim 9, wherein the recesses are formed as slots with one open end and extend perpendicular to the length axis of the profile rail.

11. The microwave oven according to claim 4, wherein a cross-section of each of the choke members (26) comprises a number of sections substantially formed as plane sheets.

12. The microwave oven according to claim 11, wherein each of the choke members (26) comprises two to seven sections.

13. The microwave oven according to claim 11, characterized in that adjacent sections of the choke members (26) form an angle from −90° to 180°.

14. The microwave oven according to claim 13, characterized in that at least a number of the adjacent sections are orthogonal to each other.

15. The microwave oven according to claim 4, further comprising a further wave choke system arranged within an outer portion of the flat oven door and enclosing the opening of the oven cavity (10).

16. The microwave oven according to claim 4, wherein each of the choke members (26) is formed as a separate part with at least three legs.

17. The microwave oven according to claim 4, wherein a free end of each of the choke members (26) is spaced from the first gap (16).

18. The microwave oven according to claim 4, wherein a free end of each of the choke members (26) is spaced from the at least one gasket (22).

19. The microwave oven according to claim 6, wherein the counter part (28) is perpendicular to the first gap (16).

20. The microwave oven according to claim 4, wherein a distance between a plane defined by the front portion of the front frame (12) and a section of the choke members (26) furthest from the front portion of the front frame is smaller than a distance between the plane defined by the front portion of the front frame (12) and a portion of the counter part (28) furthest from the front portion of the front frame.

21. The microwave oven according to claim 4, wherein an end of the second gap opposite to the first gap is open.

* * * * *